US008579086B2

(12) United States Patent
Born et al.

(10) Patent No.: US 8,579,086 B2
(45) Date of Patent: Nov. 12, 2013

(54) CRASH SAFETY DEVICE HAVING A ROPE DRIVE MECHANISM

(75) Inventors: Jean-Luc Born, Burg-Reuland (BE); Sebastien Close, Sr., Longchamps (BE); Frederic Arens, St. Vith (BE); Richard Grossmann, Lutzkampen (DE); Armin Kreuzer, Illingen (DE); Jean-Claude Dahner, Born (BE)

(73) Assignee: CTI Systems S.A., Lentzweiler (LU)

( * ) Notice: Subject to any disclaimer, the term of this patent is extended or adjusted under 35 U.S.C. 154(b) by 449 days.

(21) Appl. No.: 12/864,037

(22) PCT Filed: Jan. 22, 2008

(86) PCT No.: PCT/EP2008/050708

§ 371 (c)(1),
(2), (4) Date: Jul. 22, 2010

(87) PCT Pub. No.: WO2009/092438

PCT Pub. Date: Jul. 30, 2009

(65) Prior Publication Data

US 2011/0127112 A1 Jun. 2, 2011

(51) Int. Cl.
*A62B 1/00* (2006.01)

(52) U.S. Cl.
USPC ..... 182/232; 182/237

(58) Field of Classification Search
USPC ..... 182/231–240; 242/615, 615.3
See application file for complete search history.

(56) References Cited

U.S. PATENT DOCUMENTS

| | | | | |
|---|---|---|---|---|
| 4,029,298 | A * | 6/1977 | Lassche | 182/237 |
| 4,253,643 | A * | 3/1981 | Forester et al. | 182/239 |
| 4,653,609 | A * | 3/1987 | Devine | 182/238 |
| 5,617,937 | A | 4/1997 | Zettner et al. | |
| 5,701,972 | A * | 12/1997 | Bloder | 182/234 |
| 5,762,282 | A * | 6/1998 | Wolner | 242/390.8 |
| 6,561,334 | B2 | 5/2003 | Stark | |
| 7,798,288 | B2 * | 9/2010 | Blasek | 182/42 |
| 2007/0074946 | A1 * | 4/2007 | Straub et al. | 192/41 S |
| 2009/0211846 | A1 * | 8/2009 | Taylor | 182/231 |

FOREIGN PATENT DOCUMENTS

| | | | |
|---|---|---|---|
| DE | 4210560 | A1 | 10/1993 |
| DE | 4216055 | A1 | 11/1993 |
| DE | 4442404 | A1 | 6/1996 |
| DE | 19614512 | A1 | 10/1997 |
| DE | 19644045 | A1 | 5/1998 |
| DE | 20009895 | U1 | 12/2000 |
| EP | 0247818 | A2 | 12/1987 |
| GB | 1552667 | | 9/1979 |

* cited by examiner

*Primary Examiner* — Katherine Mitchell
*Assistant Examiner* — Daniel Cahn
(74) *Attorney, Agent, or Firm* — James E. Walton; Richard G. Eldredge

(57) ABSTRACT

The invention relates to a crash safety device having a safety rope (105) wound onto a drum, a recuperating spring tensioned by the drum during the winding of the rope, and a locking device for blocking the drum from rotation in the rope unwinding direction during the crash of a person secured by the rope. A rope drive mechanism is provided in order to unwind the rope (105) from the drum and to slowly move the rope end having a hook (290) attached thereto toward such that a person can hook onto the safety rope (105). The drive mechanism has a motor (140) driving a rope drive wheel (210) via a freewheel (200) for lowering the rope end having the hook (290). In order to rewind the rope, the motor (140) is operated in a reverse direction of rotation at a controlled rotational speed in order to limit the speed at which the rope (105) is pulled up by the tensioned recuperating spring.

15 Claims, 4 Drawing Sheets

CRASH SAFETY DEVICE HAVING A ROPE DRIVE MECHANISM

The invention relates to a fall arrest device comprising a safety rope which can be locked in the event of a fall of a secured person. Furthermore, the invention relates to a drive mechanism for a safety rope of a fall arrest device.

Such fall arrest devices are known in the prior art, see e.g. GB patent 1552667 and also EP patent application 0 247 818. These devices have a drum rotatably mounted in a housing for winding and unwinding the safety rope. During the unwinding, a return spring is tensioned which winds the rope again when the person has released the rope. Located in the drum is a locking device which prevents the further unwinding of the rope if a person connected to the rope suddenly falls. The rope to which the person can connect himself protrudes through an opening at the lower end of the fall arrest device and is provided with a connection hook.

The known fall arrest device, sometimes also referred to as a height safety device, is usually suspended from the ceiling of a factory or the like, and the connection hook of the device is normally located in the uppermost position due to the internal return spring of the device. In order to reach the connection hook, usually a line hangs from the connection hook, by means of which the rope can be pulled downwards and the safety rope can be unwound so that the person to be secured can connect himself to the device. The conventional line constantly hinders the work in the factory. The connection hook could also be reached by means of a cherry picker, but this possibility would be particularly complicated.

The problem addressed by the invention is therefore that of providing a fall arrest device which does not require a line for pulling the connection hook downwards and to which a person to be secured can easily connect himself.

In order to solve this problem, the invention provides a fall arrest device comprising a safety rope wound onto a drum, a return spring which is to be tensioned during the unwinding of the rope from the drum, and a locking device for locking the drum against rotation in the rope unwinding direction in the event of a fall of a person secured by the rope, characterized by a rope drive mechanism for unwinding the rope from the drum and for moving it downwards from the device, wherein the drive mechanism comprises a drive motor, a rope drive wheel and a freewheel, and the drive wheel is to be driven in a direction of rotation by the motor via the freewheel in order to unwind the rope and move it downwards.

With the device according to the invention, the connection hook can be lowered at the push of a button.

In order to improve the transmission of drive force from the drive wheel to the rope, the rope drive mechanism preferably comprises a pressing wheel, and the rope is passed through a gap between the drive wheel and the pressing wheel and in the gap is in frictional contact with the two wheels. The pressing force of the pressing wheel is preferably adjustable. The drive wheel may be rotatably mounted on a pivotable lever, and the lever may be pretensioned by a spring force in order to press the pressing wheel against the rope.

According to one advantageous example of embodiment, the motor is provided with a device for switching the direction of rotation of the motor between one direction of rotation and an opposite direction of rotation and for setting a predefined motor speed at least in the opposite direction of rotation in order to limit the winding speed of the rope by virtue of the set motor speed in the opposite direction of rotation of the motor. Preferably, the motor is a three-phase motor with a control circuit for switching the direction of rotation of the motor and for setting a predefined motor speed in both directions of rotation. By virtue of the set motor speed in the reverse operating mode (opposite direction of rotation), the upward jolting of the rope is prevented or limited and the rope is moved upwards only as quickly as the set motor speed allows. The motor is preferably a three-phase asynchronous motor, the speed of which in both directions of rotation can be set via a frequency inverter.

In order to prevent the rope end from being pulled upwards out of the gap between the drive wheel and the pressing wheel during the winding process, a stop is preferably arranged below the drive wheel, and a spacer is attached to the rope in order to butt against the stop when the rope reaches an upper end position. The stop may at the same time serve as a limit switch actuator.

The motor may be controlled via radio or via a busbar.

According to another aspect, the invention relates to a drive mechanism for the safety rope of a fall arrest device.

The invention will be described in more detail below with reference to the associated drawings, in which.

Figure 2:
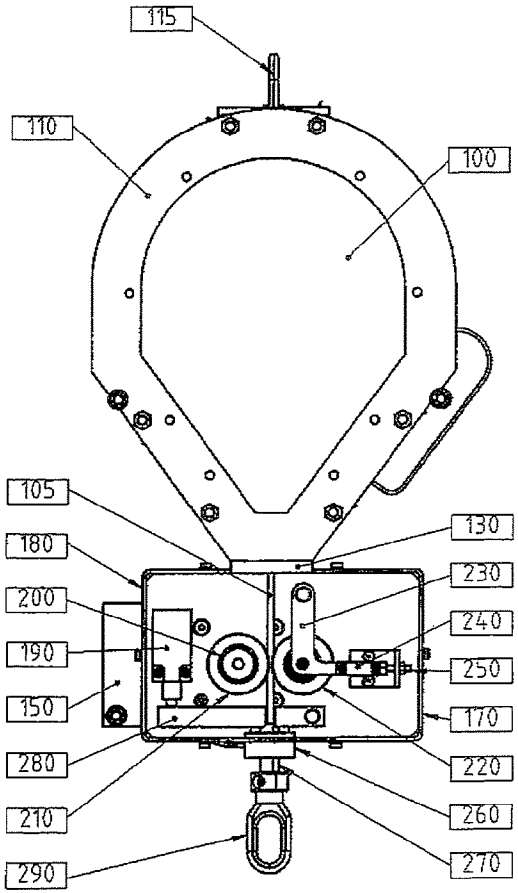
FIG. 2 shows a front view of the device of FIG. 1 with an open housing of the drive mechanism to show the internal components thereof.
Figure 1:
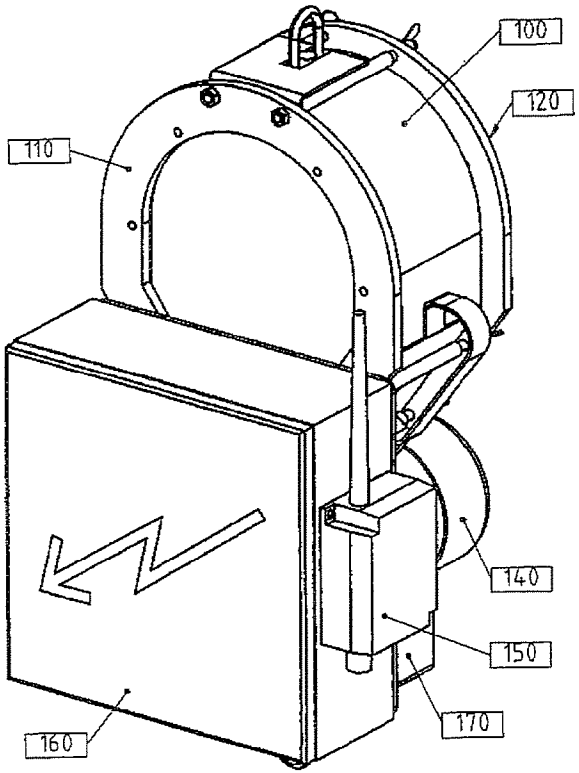
FIG. 1 shows a perspective view of the fall arrest device according to the invention with rope drive mechanism.

As shown in FIGS. 1 and 2, the fall arrest device 100 comprises a housing 110, 120, in which a rope drum (not shown) is rotatably mounted, for winding and unwinding a safety rope 105. The safety rope 105 protrudes through a rope opening (not shown) at the lower end of the housing 110, 120.

A drum (not shown) is rotatably mounted in the housing 110, 120. When a person wishing to connect himself to the safety rope 105 pulls the rope downwards and unwinds it from the drum, a return spring (not shown) is tensioned which at a later point in time, when the person detaches himself from the rope and releases the latter, pulls the safety rope back upwards again and winds it onto the drum. The fall arrest device 100 also comprises a locking mechanism (not shown) which permits a rotation of the drum for unwinding the rope when the rope is pulled slowly downwards at low speed, but prevents any rotation in the direction of unwinding of the safety rope 105 when the rope is pulled downwards at high speed, such as in the event of a fall of a person connected to the safety rope 105. A hanging means 115 is located at the top of the housing 110, 120.

A fall arrest device having these features is known in the prior art from the documents cited in the introduction and will therefore not be described in any greater detail here.

A rope drive mechanism according to the invention is attached below the drum housing 110, 120. The rope drive mechanism comprises a housing 170, 180 which may be attached to the drum housing 110, 120 via an intermediate frame or an intermediate plate 130. The rope drive mechanism comprises a drive wheel 210 and a counter-pressure wheel or pressing wheel 220, which are mounted in a housing 180, 170. The safety rope 105 extends from the drum housing 110, 120 vertically downwards through the housing 170, 180 and is passed through the gap between the drive wheel 210 and the counter-pressure wheel 220 and in the gap is in frictional contact with the wheels 210, 220 for the purpose of drive force transmission. The safety rope 105 extends below the wheels 210, 220 through a guide ring 260 which is attached to the underside of the housing 170, 180. A hook 290 is attached to the free end of the rope 105. Located above the hook 290 is a spacer 270 which is supported against the hook 290.

In the upper end position, the spacer 270 is accommodated in the guide ring 260 and bears with its upper end against a stop 280, through which the rope is passed, and which is located in the housing between the guide ring 260 and the pair of wheels 210, 220. This prevents the rope 105 from being able to be pulled upwards out of the gap between the wheels 210 and 220 during the winding of the rope. Preferably, the stop 280 is at the same time a limit switch actuator and consists of a lever which is rotatably mounted at its right-hand end and which actuates a limit switch 190 when the spacer 270 comes into contact with the stop 280.

Also located in the housing 170, 180 is a further lever or a pivotably mounted L-shaped rocker 230, on which the counter-pressure wheel 220 is rotatably mounted. A pressure spring 240 presses the counter-pressure wheel 220 against the drive wheel 210 in order to clamp the safety rope 105 between these two wheels. A pressing force adjustment mechanism 250 is provided at the free end of the spring 240 and consists of an adjusting screw with a nut, wherein the screw protrudes through an opening in an angle piece which is attached to the housing 170, 180. The counter-pressure wheel 220 preferably has a rubber or plastic body.

The drive wheel 210 is to be driven by a motor 140 which is shown in FIG. 1 and which is flanged onto the rear side of the housing 170, 180. Located on the front side of the housing 170, 180 is a terminal box 160, to which a radio receiver 150 for controlling the motor is attached. The radio control is not essential to the invention, but rather the motor may also be controlled via a busbar.

According to the invention, the motor-driven drive wheel 210 is driven via a freewheel 200 which transmits from the drive motor 140 to the drive wheel the drive force for slowly unwinding the rope 105.

Figure 3:
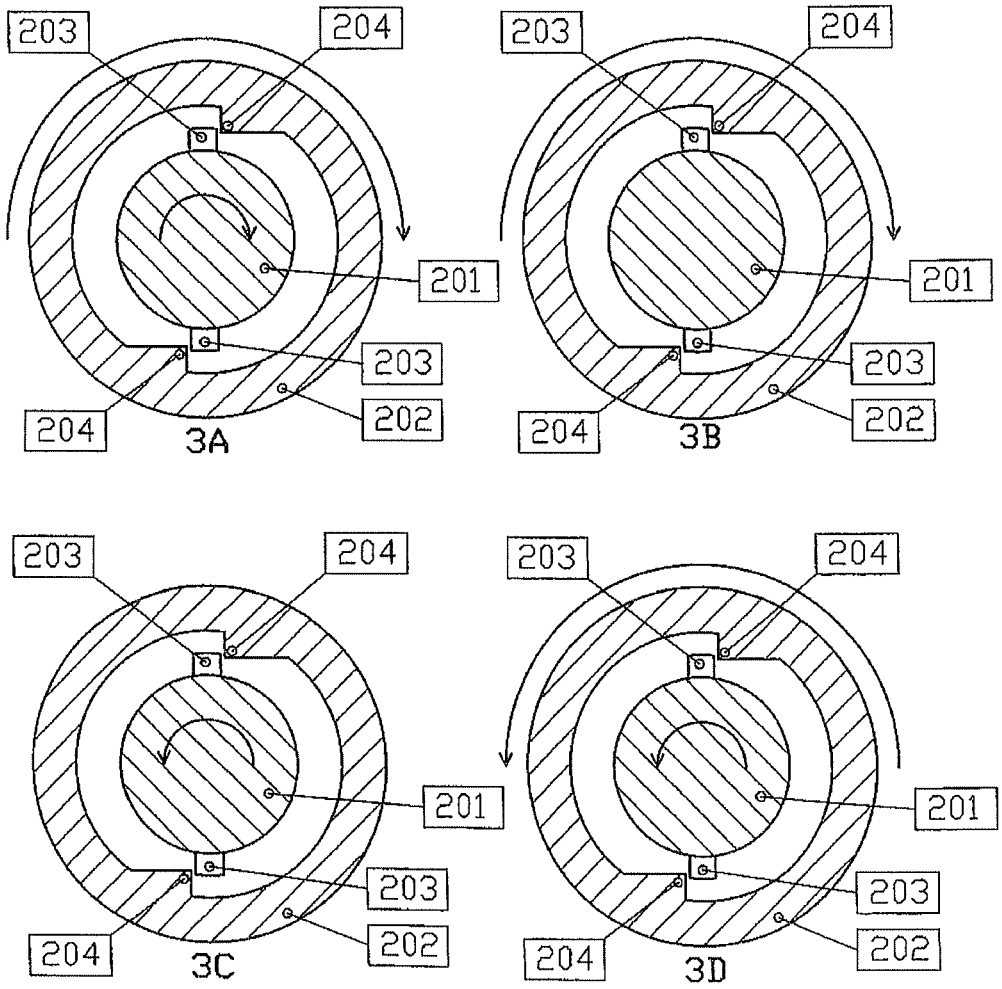
FIGS. 3A, 3B, 3C and 3D show schematic views of the freewheel to explain the mode of operation of the device.

In the following text, reference is made to FIGS. 3A, 3B, 3C and 3D in order to explain the principle of operation of the freewheel 200. These figures do not show the actual construction of a freewheel but rather serve only to explain the principle of the freewheel. As shown in these figures, the freewheel 200 has a central shaft 201 which is connected to the rotor of the motor 140, or which is the motor shaft itself. An outer ring 202 is rotatably mounted on the shaft 201. The shaft 201 has two diametrically opposed, outwardly projecting dogs 203 which interact with diametrically opposed, inwardly projecting protrusions 204 of the outer ring 202. FIG. 3A shows the freewheel 200 during the slow unwinding or downward movement of the rope. Here, the motor 140 drives the central shaft 201 in the clockwise direction. The radial dogs 203 of the shaft 201 strike the radial surfaces of the protrusions 204 of the outer ring 202 and entrain the outer ring 202 in the clockwise direction. When the rope is sufficiently unwound, a person can connect himself to the safety rope 105.

FIG. 3B shows the freewheel 200 in the event of a fall of a secured person. In this case, the outer ring 202 is suddenly driven by the rope 105 at high speed in the clockwise direction. The inner shaft 201 is now stationary (motor is not rotating) and the protrusions 204 of the outer ring 202 move over the dogs 203 of the inner shaft 201. The locking device in the drum housing 110, 120 responds and prevents the further unwinding of the rope, i.e. the fall of the secured person.

FIG. 3C shows the freewheel 200 with the outer ring 202 stationary and the motor 140 (the shaft 201) rotating in the anticlockwise direction, i.e. the lower end of the rope 105 is connected to a person to be secured and cannot move upwards, the inner shaft 201 rotates freely in the anticlockwise direction, without driving the outer ring 202, and the dogs 203 slide over the tangential surfaces of the protrusions 204.

FIG. 3D shows the freewheel 200 with the lower end of the safety rope 105 released. The outer ring 202 is then driven in the anticlockwise direction by the safety rope 105, which is pulled up by the tensioned return spring (not shown) and wound. The outer ring 202 then has the tendency to entrain the inner shaft 201 in the anticlockwise direction via the freewheel 200 due to the bearing of the radial surfaces of the protrusions 204 of the outer ring 202 against the radial dogs 203 of the inner shaft 201. However, since the spring force of the return spring of the height safety device is lower than the force applied by the motor 140 to the drive wheel 210, the speed with which the rope 105 is raised matches the speed of rotation of the drive wheel 210.

Figure 4:
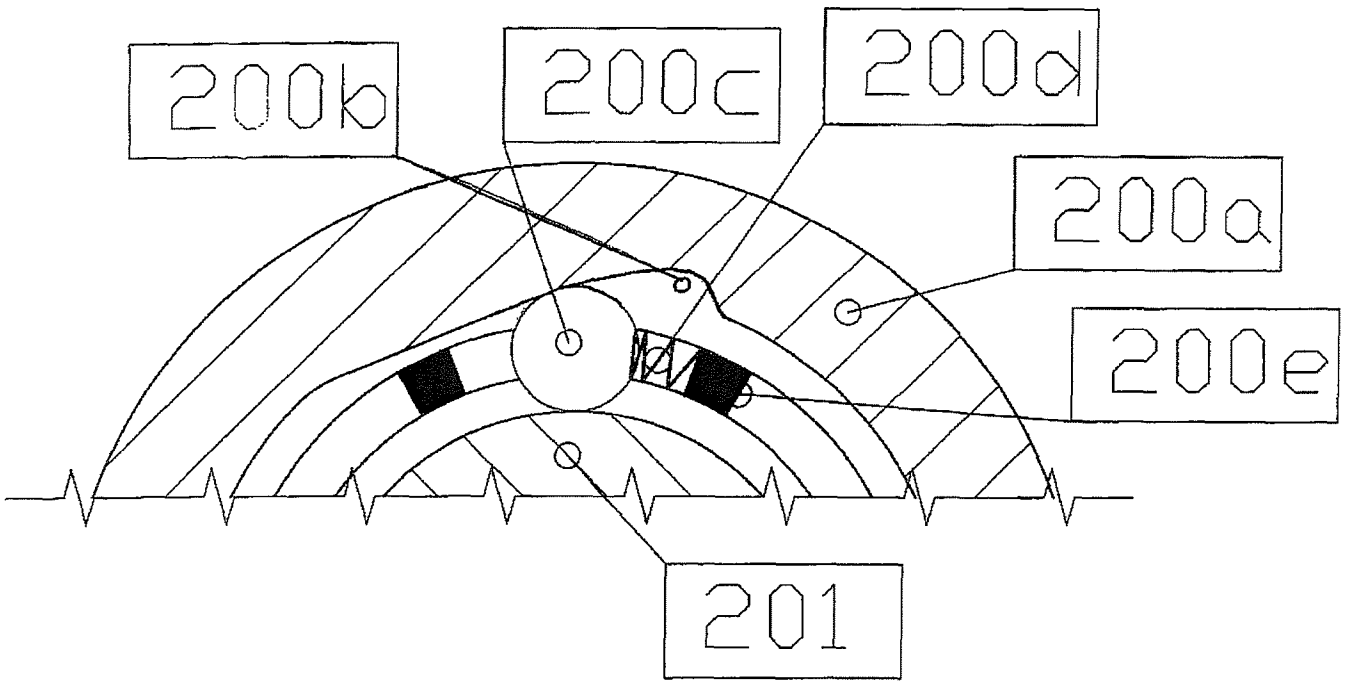
FIG. 4 shows a schematic view of a sleeve-type freewheel.

As already mentioned, FIGS. 3A, 3B, 3C and 3D show only the principle of a freewheel and not the actual construction of the freewheel. Freewheels are generally known in the prior art, see e.g. DE 200 09 895 U1, DE 42 16 055 C2, DE 42 10 560 C2, DE 196 045 C2, DE 44 42 404 C2 and DE 196 14 512 C2. As shown in FIG. 4, such a freewheel consists of a sleeve 200*a* which has on its inner surface axial recesses 200*b* with clamping faces. Clamping bodies 200*c*, such as e.g. rollers or needles, are guided in a cage 200*e* and are located in the recesses 200*b*. The cage 200*e* has spring elements 200*d* (shown schematically as helical springs) for pressing the clamping bodies 200*c* against the clamping faces and also against the shaft 201. A plurality of recesses 200*b* (with clamping faces), clamping bodies 200*c* and pressing springs 200*d* are of course arranged in a manner distributed around the inner circumference of the freewheel sleeve 200*a* and the cage 200*e*. The freewheel 200 may be a component of the drive wheel 210 and the drive wheel 210 may be mounted on the shaft 201 via the freewheel 200 or the freewheel sleeve. To this end, sliding bearings or rolling bearings are located on both sides of the clamping bodies. The drive wheel 210 has a rubber or plastic body or outer ring, which is arranged on the freewheel 200.

According to the preferred example of embodiment, the rope is to be prevented from being wound up at maximum speed by the return spring when the secured person has released the safety rope 105, since otherwise the rope 105 will not be correctly wound onto the rope drum (not shown) and the spacer 270 would move into the end position without being braked in any way and the return spring (not shown) might be damaged.

This is preferably achieved by using a three-phase asynchronous motor 140, the speed of which is able to be set in both directions of rotation. The reversal of the direction of rotation takes place by means of a frequency inverter. Such a motor with an inverter and speed control is generally known in the prior art and can be obtained from the company Lenze (motor type MDERRAXX 071-12). In the forward operating mode, the rope 105 is moved downwards according to the set motor speed. In the reverse operating mode, the motor running at a set speed prevents the rope 105 from being pulled up too quickly by the return spring and butting hard against the end stop. The winding speed of the rope in the reverse operating mode of the motor 140 is therefore limited by virtue of the predefined speed of the motor 140.

Figure 5:
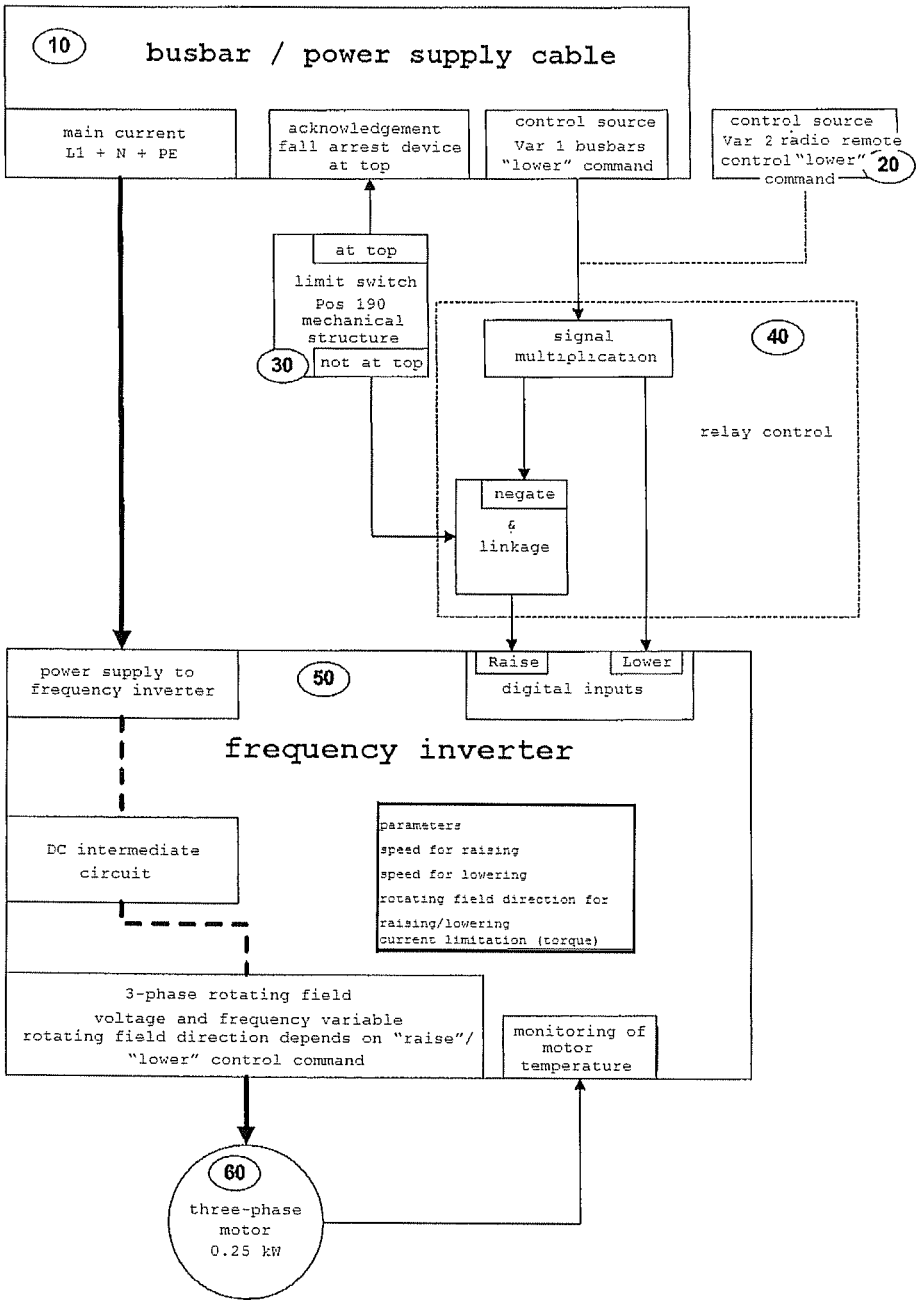
FIG. 5 shows the block diagram of the electronic control of the drive motor.

FIG. 5 shows a block diagram of the electrical control of the fall arrest device according to the invention with rope drive mechanism. It consists of the busbars/power supply cables 10 or the alternative actuation via a radio remote control 20, of the end-of-travel switch 30 (190 in FIG. 2), the relay switching logic 10, a single-phase frequency inverter 50 and a three-phase asynchronous motor (140 in FIG. 1).

The busbars/power supply cables 10 form the electrical interface for supplying power to and controlling the fall arrest device. As the main current, a 1-phase supply with 230 VAC and protective earth is supplied (L1+N+PE).

In order to lower the safety rope 105, a control signal is transmitted to the relay logic 40. This can take place via the busbars/power supply cables 10. Alternatively, this may be transmitted via a radio remote control 20. The control 20 is a commercially available radio remote control according to the prior art.

As an acknowledgement, a control signal is transmitted when the limit switch 30 (190 in FIG. 2) is actuated into the upper position. This is transmitted in the busbar/power supply cable and is available for further processing in a superordinate control system.

The relay control 40 consists of two commercially available relays. One relay is for transmitting the "lower" control signal and the other relay is responsible for transmitting the "raise" control signal to the frequency inverter 50. The frequency inverter is a device or a control circuit for switching between the right and left operating mode and for setting a desired speed in both operating directions. Input signals of the relay control 40 are the "not at top" signal of the end-of-travel switch 30 and the "lower" control signal of 10 and 20. Table 1 shows the states of the relay control.

TABLE 1

| Logic of the relay control | | | | |
|---|---|---|---|---|
| Limit switch | | Control signal | Digital input of inverter | |
| At top | Not at top | Lower | Raise | Lower |
| x | | | | |
| x | | x | | x |
| | x | x | | x |
| | x | | x | |
| | x | x and current limit | | x/is not carried out |

x = state applies

A commercially available single-phase frequency inverter is shown at 50. As the power supply, the power is transmitted by the busbars/power supply cables 10. Internally, the AC voltage is converted via a rectifier into a DC voltage which supplies the DC intermediate circuit. A variable three-phase rotating field is generated from the DC intermediate circuit. Depending on the "raise" or "lower" control command, the rotating field is a right-rotating or left-rotating field. The frequency and voltage depend on the preselected speed. The speed selection is set in the frequency inverter. Depending on the actuation of the relay control 40, the "raise" or "lower" control signal is applied to the digital inputs. Different values may be assigned to the control signals. In order to minimize the mechanical wear when the rope is fully unwound, the mechanical drive torque is limited on the basis of the current limitation. If the limit value of the set current limit is exceeded, no lowering rotating field is output by the frequency inverter, despite a "lower" control command.

The three-phase asynchronous motor 60 is a commercially available three-phase motor with a temperature monitoring sensor. The temperature monitoring sensor is monitored in the frequency inverter 50 and switches off the drive in the event of a malfunction.

The invention claimed is:

1. Fall arrest device comprising:

a rope wound onto a drum;

a return spring configured to be tensioned during unwinding of the rope from the drum;

a locking device for locking the drum against rotation in a rope unwinding direction when a fall of a person secured by the rope occurs;

a rope drive mechanism for unwinding the rope from the drum and for moving the rope downward, the rope drive mechanism comprising:

a drive motor;

a rope drive wheel having a freewheel comprising:

a sleeve having axial recesses with clamping faces on its inner surface, wherein clamping bodies are guided in a cage and are located in the recesses; and a central shaft;

a pressing wheel, and the rope is passed through a gap between the drive wheel and the pressing wheel and in the gap is in frictional contact with the wheels;

wherein the sleeve is configured to be driven in a first direction of rotation by the motor via rotating the central shaft in the first direction which unwinds the rope and moves the rope downward; and wherein the motor is configured to rotate the central shaft in a reverse second direction of rotation to limit a rewinding speed of the rope by the return spring.

2. Fall arrest device according to claim 1, further having a spring which presses against the pressing wheel.

3. Fall arrest device according to claim 1, wherein the pressing wheel is rotatably mounted on a pivotable lever, and the lever is pretensioned by a spring force in order to press the pressing wheel against the rope.

4. Fall arrest device according to claim 1, wherein the motor is provided with a device for switching a direction of rotation of the motor between one direction of rotation and an opposite direction of rotation and for setting a predefined motor speed at least in the opposite direction of rotation in order to limit the rewinding speed of the rope by virtue of the set predefined motor speed in the opposite direction of rotation of the motor.

5. Fall arrest device according to claim 4, wherein the motor is a three-phase motor with a control circuit for switching the direction of rotation of the motor and for setting a predefined motor speed in both directions of rotation.

6. Fall arrest device according to claim 5, further comprising:

a frequency inverter for setting the motor speed in both directions of rotation.

7. Fall arrest device according to claim 1, further comprising:

a stop arranged below the drive wheel, and a spacer attached to the rope in order to butt against the stop when a rope end of the rope reaches an upper end position.

8. Fall arrest device according to claim 7, wherein the stop is a limit switch actuator.

9. Fall arrest device according to claim 1, wherein the motor can be controlled via radio or via a busbar.

10. Fall arrest device according to claim 1, wherein the freewheel is a component of the drive wheel and the drive wheel is mounted via the freewheel on the central shaft driven by the motor.

11. Fall arrest device according to claim 1 wherein the drive wheel has a rubber or plastic body, wherein the rubber or plastic body is arranged on the freewheel.

12. Fall arrest device according to claim 1, wherein the pressing wheel has a rubber or plastic body.

13. Fall arrest device according to claim 1, wherein the drum is arranged in a drum housing and the rope drive mechanism has a rope housing which is attached to and below the drum housing.

14. Fall arrest device according to claim 13, wherein the rope is passed through the rope housing and the drive wheel and also the freewheel are located in the rope housing.

15. Fall arrest device according to claim 7, further comprising:

a guide ring for the spacer provided on a housing of the rope drive mechanism for accommodating the spacer in an upper end position.

* * * * *